US010011942B2

(12) United States Patent
Ricciardi

(10) Patent No.: US 10,011,942 B2
(45) Date of Patent: Jul. 3, 2018

(54) WET CLOTHES DRYING HAMPER

(71) Applicant: Adam Ricciardi, Mount Vernon, NY (US)

(72) Inventor: Adam Ricciardi, Mount Vernon, NY (US)

( * ) Notice: Subject to any disclaimer, the term of this patent is extended or adjusted under 35 U.S.C. 154(b) by 0 days.

(21) Appl. No.: 15/441,724

(22) Filed: Feb. 24, 2017

(65) Prior Publication Data

US 2017/0247830 A1 Aug. 31, 2017

Related U.S. Application Data

(60) Provisional application No. 62/300,146, filed on Feb. 26, 2016.

(51) Int. Cl.

| | |
|---|---|
| ***D06F 57/12*** | (2006.01) |
| ***D06F 57/06*** | (2006.01) |
| ***D06F 60/00*** | (2009.01) |
| ***D06F 95/00*** | (2006.01) |
| *D06F 58/10* | (2006.01) |

(52) U.S. Cl.

CPC ..... *D06F 57/12* (2013.01); *D06F 57/06* (2013.01); *D06F 60/00* (2013.01); *D06F 95/002* (2013.01); *D06F 58/10* (2013.01)

(58) Field of Classification Search

CPC ..... D06F 57/12; D06F 57/06; D06F 60/00; D06F 95/002; D06F 58/10; B23B 3/00; B23B 3/02

USPC ..... 34/81, 595–610; 68/5 R, 20; 211/2, 118, 211/188; 206/278

See application file for complete search history.

(56) References Cited

U.S. PATENT DOCUMENTS

| | | | | | |
|---|---|---|---|---|---|
| 103,424 | A | * | 5/1870 | Brown | D06F 57/00 211/118 |
| 2,225,089 | A | * | 12/1940 | Vadnais | D06F 95/006 206/38 |
| 3,115,968 | A | * | 12/1963 | Peterson | B65D 5/42 206/300 |
| 3,452,957 | A | * | 7/1969 | Zuelsdorf | D06F 95/002 248/201 |
| 4,577,767 | A | * | 3/1986 | Geschwender | A47G 25/0664 108/186 |
| 4,860,981 | A | * | 8/1989 | Pierson | B65B 67/1227 248/97 |
| 5,301,968 | A | * | 4/1994 | Ward | A61G 5/00 280/47.4 |

(Continued)

FOREIGN PATENT DOCUMENTS

| | | | | |
|---|---|---|---|---|
| CA | 2867614 | A1 * | 9/2013 | A45C 5/005 |
| GB | 1436294 | A * | 5/1976 | B65G 9/00 |
| JP | 06336299 | A * | 12/1994 | |

*Primary Examiner* — Stephen M Gravini
(74) *Attorney, Agent, or Firm* — Massina Pat & TM Law

(57) ABSTRACT

A clothes hamper includes a hamper body extending from a generally closed end to a generally open end with an interior chamber defined within the hamper body. A rack assembly defines one or more hanging elements and is sized and configured to fit within the interior chamber. An extension assembly is positioned within the interior chamber and is configured to facilitate movement of the rack assembly between a retracted position within the interior chamber and an extended position wherein at least a portion of the rack assembly is outside of the hamper body.

18 Claims, 8 Drawing Sheets

(56) References Cited

U.S. PATENT DOCUMENTS

| | | | | | |
|---|---|---|---|---|---|
| 5,356,024 | A * | 10/1994 | Ho | B65D 9/10 | 220/666 |
| 5,671,858 | A * | 9/1997 | Hsu | B65D 11/18 | 220/9.2 |
| 5,964,533 | A * | 10/1999 | Ziglar | D06F 95/002 | 220/9.2 |
| 5,970,637 | A * | 10/1999 | Mohan | D06F 71/20 | 223/70 |
| 6,019,445 | A * | 2/2000 | Gades | D06F 95/002 | 312/245 |
| 6,089,394 | A * | 7/2000 | Ziglar | D06F 95/002 | 220/6 |
| 6,588,620 | B1 * | 7/2003 | Thuma | D06F 95/002 | 220/23.91 |
| 8,100,280 | B1 * | 1/2012 | Hernandez | D06F 95/002 | 206/278 |
| 8,365,435 | B2 * | 2/2013 | Poy | D06F 60/00 | 34/143 |
| 8,910,813 | B1 * | 12/2014 | Barre | D06F 95/002 | 220/23.83 |
| 8,998,246 | B2 * | 4/2015 | Griffard | B62B 3/025 | 280/47.34 |
| 9,233,703 | B2 * | 1/2016 | Kassab Arabo | B62B 3/00 | |
| 9,708,754 | B2 * | 7/2017 | Philip | D06F 95/002 | |
| 2006/0157358 | A1 * | 7/2006 | Heidel | D06F 95/002 | 206/278 |
| 2010/0040515 | A1 * | 2/2010 | Lovelace | A61L 2/202 | 422/186.08 |
| 2016/0167832 | A1 * | 6/2016 | Silverman | D06F 95/004 | 220/9.2 |
| 2017/0247830 | A1 * | 8/2017 | Ricciardi | D06F 57/12 | |

* cited by examiner

WET CLOTHES DRYING HAMPER

This application claims the benefit of U.S. Provisional Application No. 62/300,146, filed Feb. 26, 2016, the contents of which are incorporated herein by reference.

FIELD OF THE INVENTION

This invention relates to a hamper. More particularly, the invention relates to a hamper for receiving and drying wet clothes.

BACKGROUND OF THE INVENTION

A question faced by many athletes is what to do with post workout clothes that are thoroughly soaked through by perspiration. People that work outdoors in the hot sun or in rainy conditions face a similar problem. Swimmers are another example of people that often have wet clothes. Since daily laundry is typically not an option, the wet clothes pile up between laundry days. If the wet clothes are placed in a hamper with the normal laundry, the moisture, smell and bacteria may be transferred to the normal laundry. While a second, common hamper may be considered, such does not solve the problem since the wet clothes just sit in the hamper without getting dry, but instead remaining in a wet pile. By laundry day, the clothes remain wet and allow for bacteria, mold, or bad odor to develop. Some people instead choose to place the clothes in the bathroom, bedroom or laundry room on the floor or to hang, but it is an eyesore.

Accordingly, there is a need for a storage device for wet clothes that is aesthetically pleasing while allowing the clothes to dry out.

SUMMARY OF THE INVENTION

In at least one embodiment, the present invention provides a wet clothes drying hamper which allows the user to store soaked clothes in an aesthetically pleasing way, and have them dry for the next laundry day. No more wet piles of clothes on the floor or hanging in the bathroom, or wet, smelly clothes when doing laundry.

In at least one embodiment, the present invention provides a clothes hamper including a hamper body extending from a generally closed end to a generally open end with an interior chamber defined within the hamper body. A rack assembly defines one or more hanging elements and is sized and configured to fit within the interior chamber. An extension assembly is positioned within the interior chamber and is configured to facilitate movement of the rack assembly between a retracted position within the interior chamber and an extended position wherein at least a portion of the rack assembly is outside of the hamper body.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of the invention. In the drawings.

DETAILED DESCRIPTION OF THE INVENTION

Figure 1:
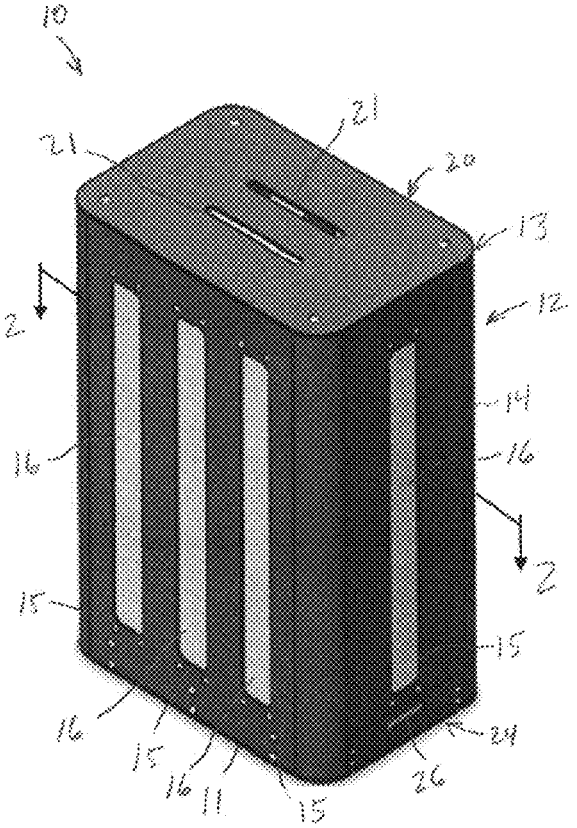
FIG. 1 is a perspective view of an exemplary wet clothes drying hamper in accordance with an embodiment of the invention.

In the drawings, like numerals indicate like elements throughout. Certain terminology is used herein for convenience only and is not to be taken as a limitation on the present invention. The following describes preferred embodiments of the present invention. However, it should be understood, based on this disclosure, that the invention is not limited by the preferred embodiments described herein.

Figure 2:
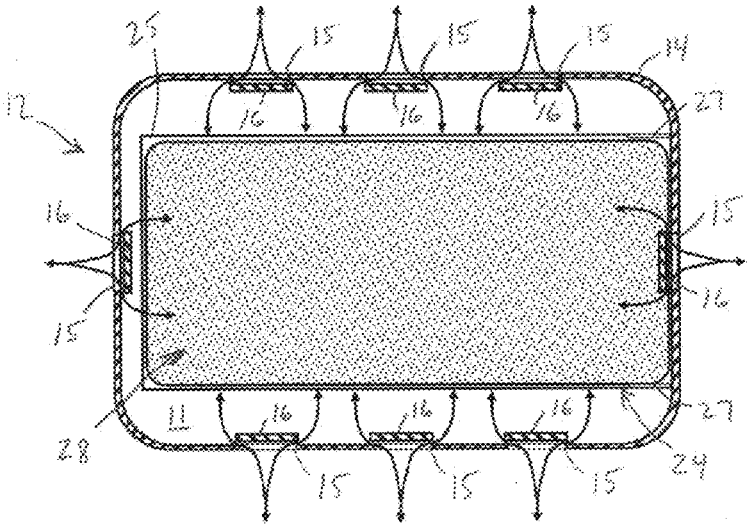
FIG. 2 is a cross-sectional view along the line 2-2 in FIG. 1 with the extension and rack assemblies omitted.
Figure 3:
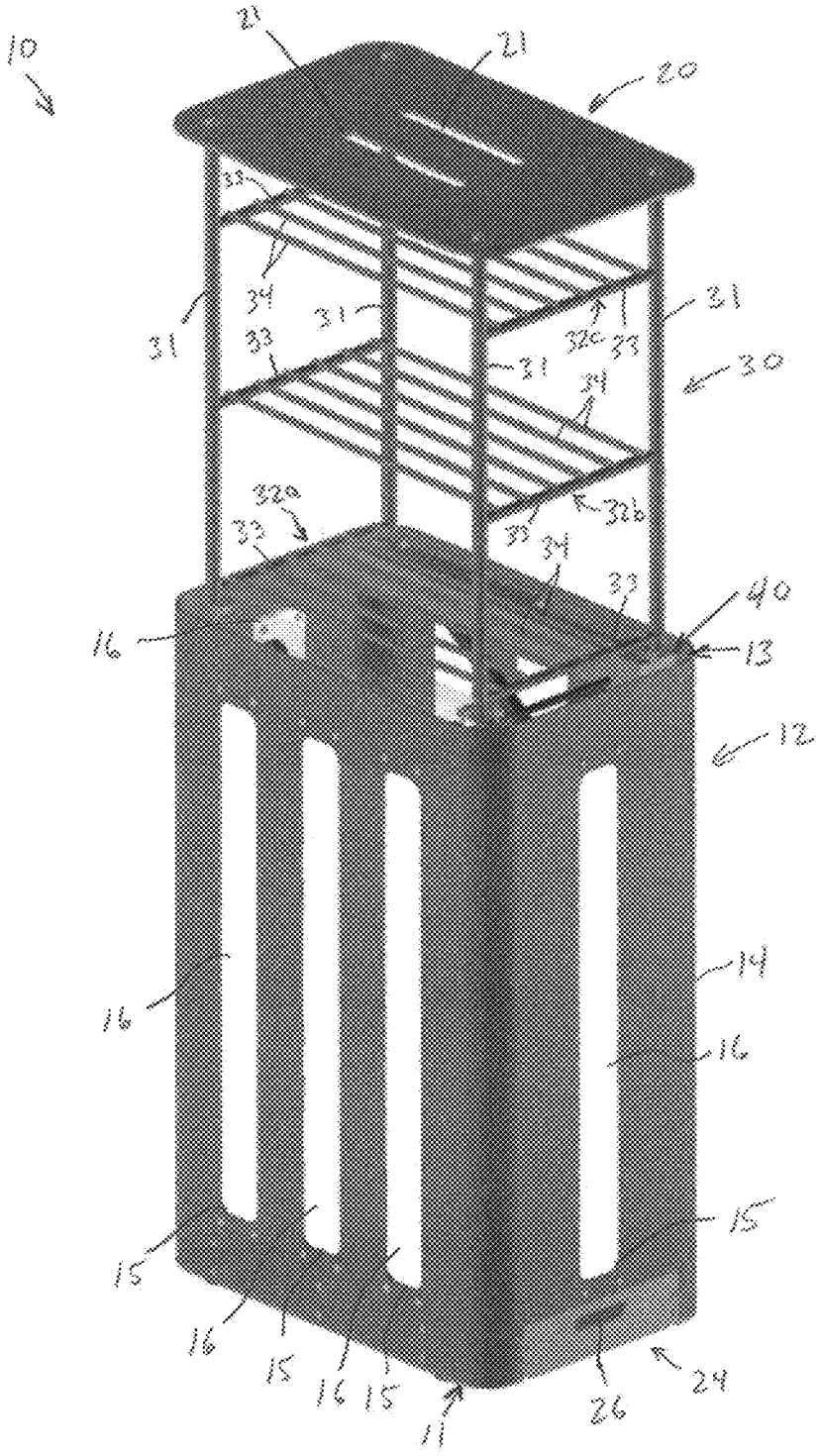
FIG. 3 is a perspective view of the wet clothes drying hamper of FIG. 1 with the extension and rack assemblies in an extended position.

Referring to FIGS. 1-5, an exemplary wet clothes drying hamper 10 in accordance with embodiment of the invention will be described. The hamper 10 generally includes a basket 12, a cover 20, a rack assembly 30 and an extension assembly 40. The basket 12 is preferably a normal size hamper body 14 extending between a closed end 11 and an open end 13. The basket 12 is shown having a rectangular configuration but may have any desired configuration, eg, square, round, oval, whichever looks the best and holds the most clothes. Preferably it has aesthetically pleasing modern looking exterior. The cover 20 extends across and generally closes the open end 13 of the basket 12. In the present embodiment, the cover 20 is attached to and moves with the rack assembly 30, as illustrated in FIG. 3, but may be removable independent of the rack assembly 30. The cover 20 includes a pair of slots 21. The slots 21 provide for air flow, but also define a handle which allows the cover 20 to be gripped and moved to the open position illustrated in FIG. 3.

The basket body 14 preferably is made of high quality plastic or other desired materials and has passages 15 therethrough to allow for ventilation. In the present embodiment, a cedar strip or panel 16 extends over each passage 15. Referring to FIG. 2, the cedar panels 16 are spaced from the interior surface of the basket body 14, for example, via standoffs, such that air may flow into and out of the basket 12, as indicated by the arrows. The cedar panels 16 are configured to absorb moisture and odor and provide a pleasant smell. While cedar panels are described herein, the invention is not limited to such and may include other natural or synthetic moisture and/or odor absorbing materials. Additionally, the passages 15 are not limited to the size, configuration or number illustrated. For example, alternatively the basket body 14 may have a mesh configuration with a plurality of small passages. The panels 16 could then be placed in desired locations within the basket 12, independent of the location of the passages.

At the closed end 11 of the basket 12, an absorbent mat 28 is preferably provided to collect moisture which may drip from clothes supported on the rack assembly 30. The mat 28 is preferably a thick, industrial absorbent mat made from, for example, cellulose or meltblown polypropylene. In the illustrated embodiment, the mat 28 is supported on a support surface 25 of a pull-out draw 24. In the illustrated embodiment, the pull-out draw 24 includes a handle 26, which may extend from the draw surface, may be a hole in the surface or any other desired structure which allows the draw 24 to be gripped and pulled from the basket body 14 to access the absorbent mat 28. The draw 24 may include side walls 27 (see FIG. 4) which extend partially or fully along the sides of the support surface 25 to maintain the position of the mat 28.

Figure 4:
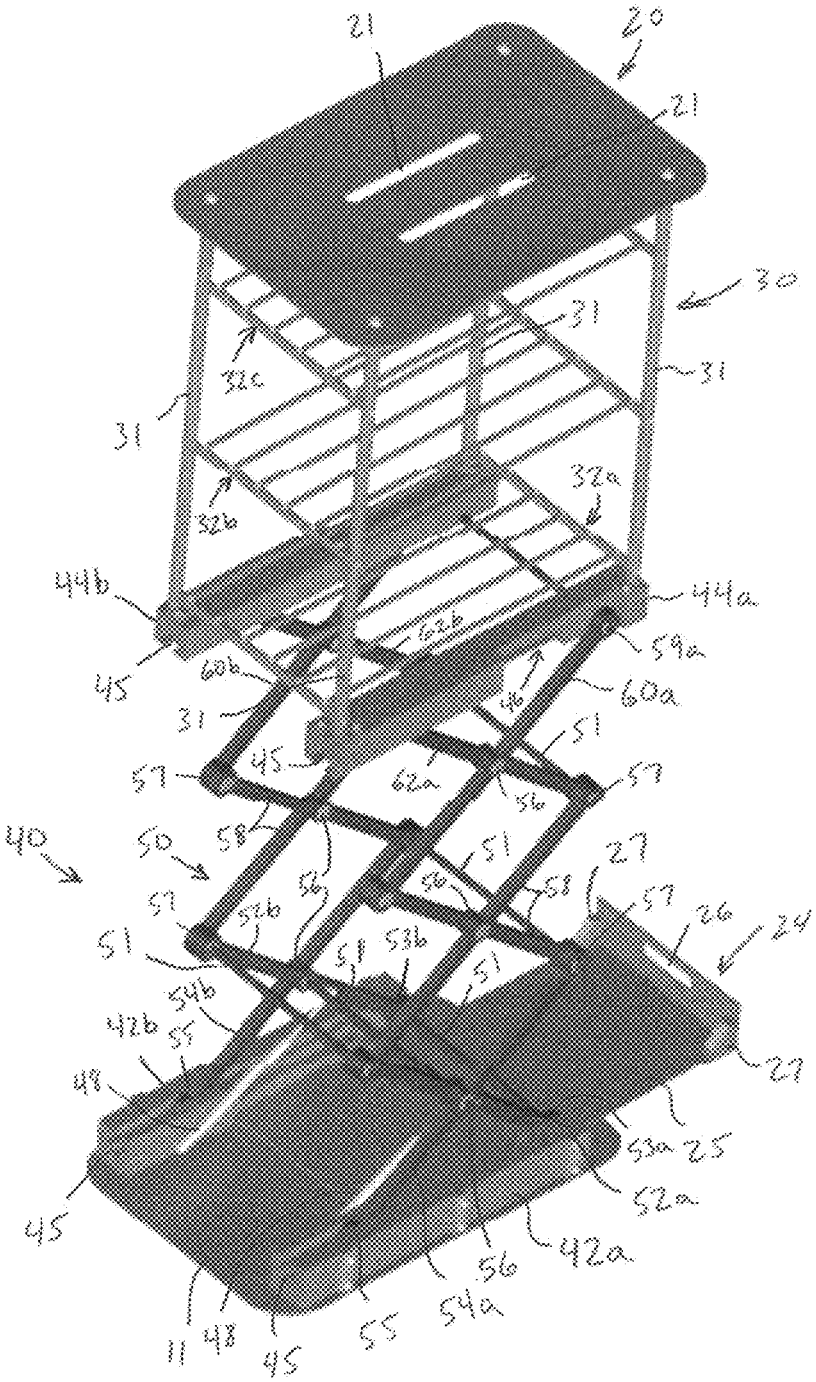
FIG. 4 is a perspective view of the wet clothes drying hamper of FIG. 1 with the draw open, the extension and rack assemblies in an extended position, and the basket body omitted.

Referring to FIGS. 3 and 4, the rack assembly 30 has a configuration which complements the interior configuration of the basket 12. In the present embodiment, the rack assembly 30 includes four corner posts 31 which are supported on and extend from a portion of the extension assembly 40, as will be described in more detail hereinafter. A plurality of shelves 32*a*, 32*b*, 32*c* are supported by the posts 31 in spaced relation to one another. While three shelves are illustrated, the invention is not limited to such. For example, the hamper 10' illustrated in FIG. 6 includes two shelves 32*a*, 32*b*. In other respects, the hamper 10' is substantially the same as the hamper 10 of the present embodiment. Each of the shelves 32*a*, 32*b*, 32*c* includes a plurality of hanging rods 34 extending between end rods 33 which connect to respective posts 31. The configuration of the shelves 32*a*, 32*b*, 32*c* allows a user to lay clothing across multiple hanging rods 34 or drape a piece of clothing over one or more of the hanging rods 34. Portions of the rack assembly 30, for example, the shelves 32*a*, 32*b*, 32*c*, may be made from moisture absorbing materials, for example, cedar. The rack assembly 30 is not limited to the illustrated shelves and may have other configurations, including configurations which have other types of hanging elements, e.g. hooks, cords, planar surfaces with through holes and the like.

Figure 5:
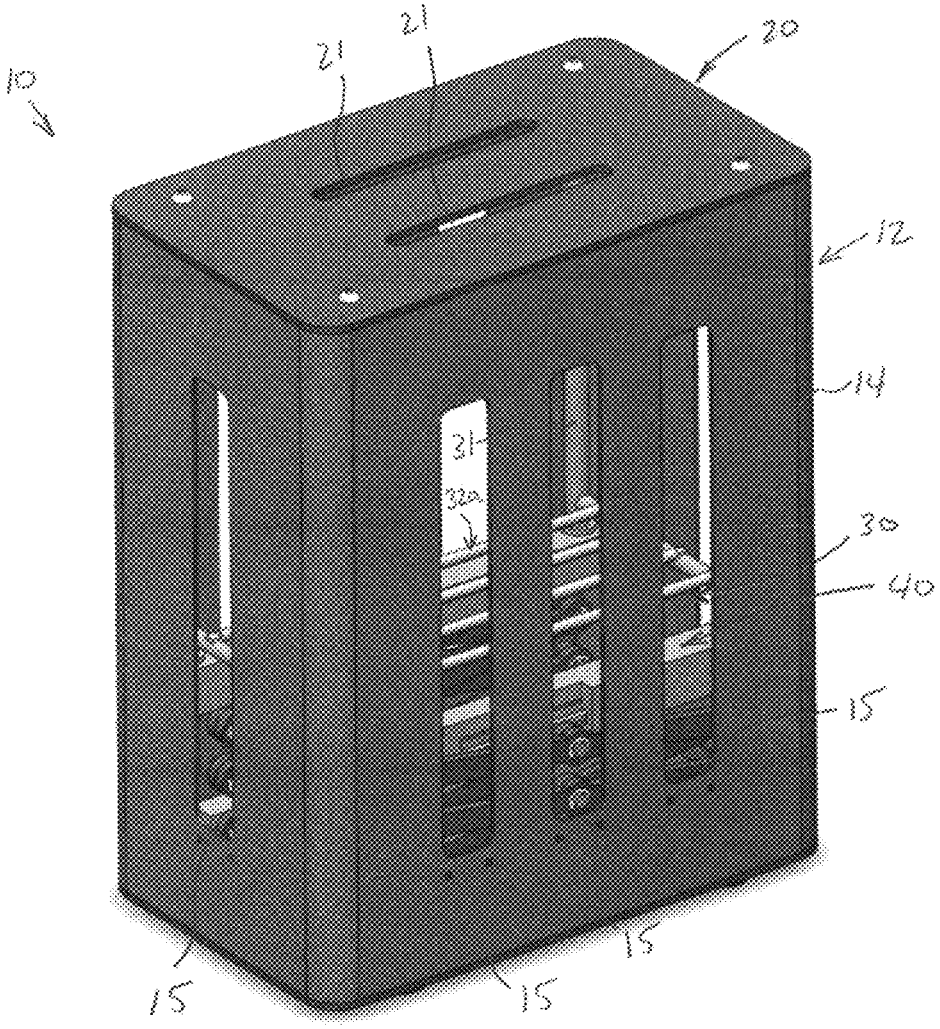
FIG. 5 is a perspective view of the wet clothes drying hamper of FIG. 1 with the extension and rack assemblies in a retracted position with the cedar panels omitted.

Referring to FIG. 4, the exemplary extension assembly 40 will be described. In the present embodiment, the extension assembly 40 includes a scissor lift assembly 50 extending between bottom rails 42*a*, 42*b* and top rails 44*a*, 44*b*. The bottom rails 42*a*, 42*b* are secured on the bottom surface 11 of the basket 12. The posts 31 of the rack assembly 30 are connected to respective ones of the top rails 44*a*, 44*b*. As such, the rack assembly 30 moves between the retracted position within the basket 12, as illustrated in FIG. 5, and the extended position extended from the basket 12, as illustrated in FIGS. 3 and 4, as the scissor lift assembly 50 is retracted or extended.

The illustrated scissor lift assembly 50 includes a pair of lower fixed pivot arms 52*a*, 52*b*, each with one end pivotally attached to a respective bottom rail 42*a*, 42*b* at a fixed pivot location 53*a*, 53*b*. A pair of lower sliding pivot arms 54*a*, 54*b* cross the fixed pivot arms 52*a*, 52*b*, with mid-pivots 56 connecting the respective arms 52*a*, 54*a* and 52*b*, 54*b*. One end of each lower sliding pivot arm 54*a*, 54*b* has a wheel 55 or the like that rides in a track 45 of the respective bottom rail 42*a*, 42*b*. The wheels 55 slide within the tracks as the scissor lift assembly 50 is extended or retracted. A plurality of intermediate pivot arms 58 are pivotally connected to the lower fixed and sliding pivot arms 52*a*, 52*b*, 54*a*, 54*b* at end-pivots 57. The intermediate pivot arms 58 may be pivotally connected to one another at mid-pivots 56, if desired for additionally stability. Stability bars 51 may also extend between some or all of the arms as desired.

Figure 6:
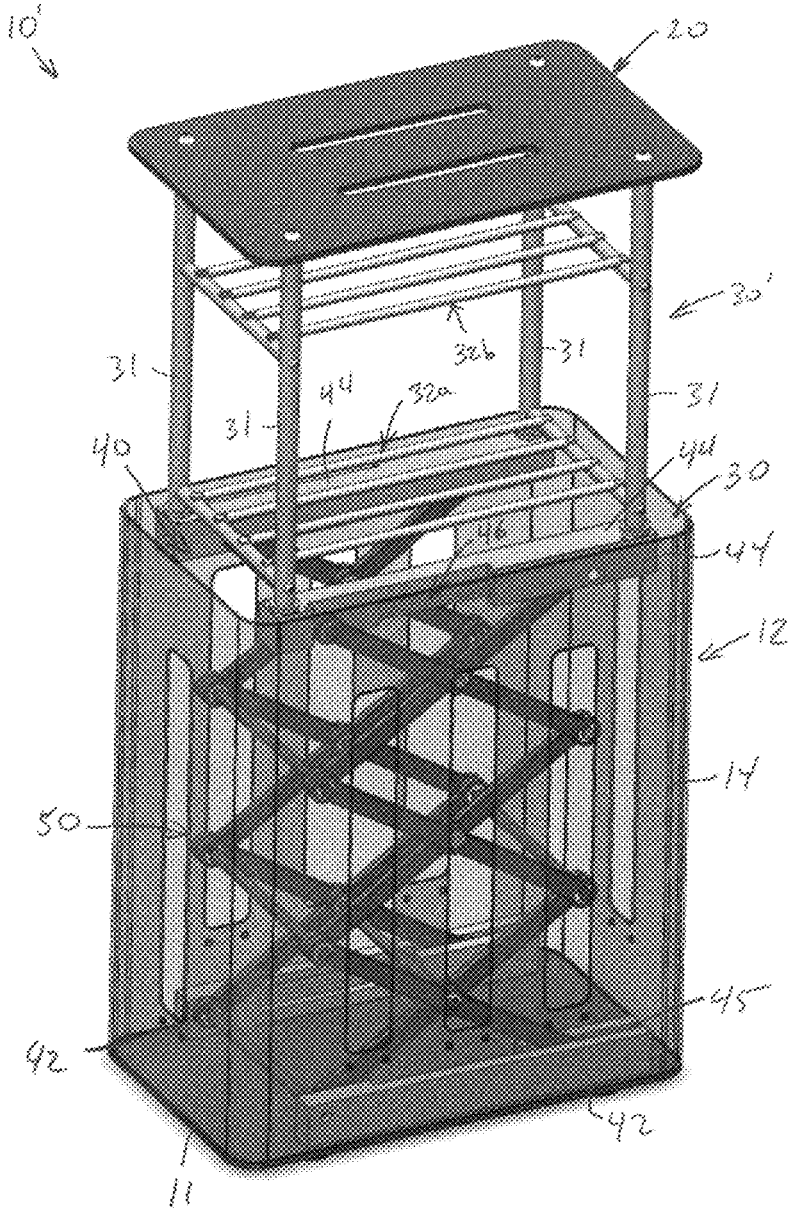
FIG. 6 is a perspective view of an exemplary wet clothes drying hamper in accordance with another embodiment of the invention with the extension and rack assemblies in an extended position and the basket body and cedar panels shown transparently.

The intermediate pivot arms 58 ultimately pivotally connect with upper fixed pivot arms 60*a*, 60*b* and upper sliding pivot arms 62*a*, 62*b*. The number of intermediate pivot arms 58 is selected based on the desired amount of extension. Each of the upper fixed pivot arms 60*a*, 60*b* has one end pivotally attached to a respective top rail 44*a*, 44*b* at a fixed pivot location 59*a*, 59*b*. One end of each upper sliding pivot arm 62*a*, 62*b* has a wheel 55 or the like that rides in a track 45 of the respective top rail 44*a*, 44*b*. The wheels 55 slide within the tracks as the scissor lift assembly 50 is extended or retracted. As illustrated in FIGS. 4 and 6, the bottom and top rails 42*a*, 42*b*, 44*a*, 44*b* may have notches 46 or the like to accommodate the arms as they pivot relative to the rails. To assist with extension and retraction of the scissor lift assembly 50, pneumatic struts 48 may extend between the bottom rails 42*a*, 42*b* and respective arms 52*a*, 52*b*.

In operation, a user grips the cover 20 via the slots 21 and extends the rack and extension assemblies 30, 40 such that the rack assembly 30 is in the extended position illustrated in FIG. 3. The wet clothes are then placed on the shelves 32*a*, 32*b*, 32*c* and/or hung on the hanging rods 34. Once the clothes have been positioned on the rack assembly 30, the cover 20 is lowered such that the extension assembly 40 is retracted and the rack assembly 30 is lowered to the retracted position, as illustrated in FIG. 5, such that the shelves 32*a*, 32*b*, 32*c*, and thereby the wet clothes, are supported within the basket 12 in a non-piled configuration. The non-piled wet clothes more easily dry do to ventilation through the basket 12 along with absorption by the cedar panels 16 and the mat 28.

Figure 7:
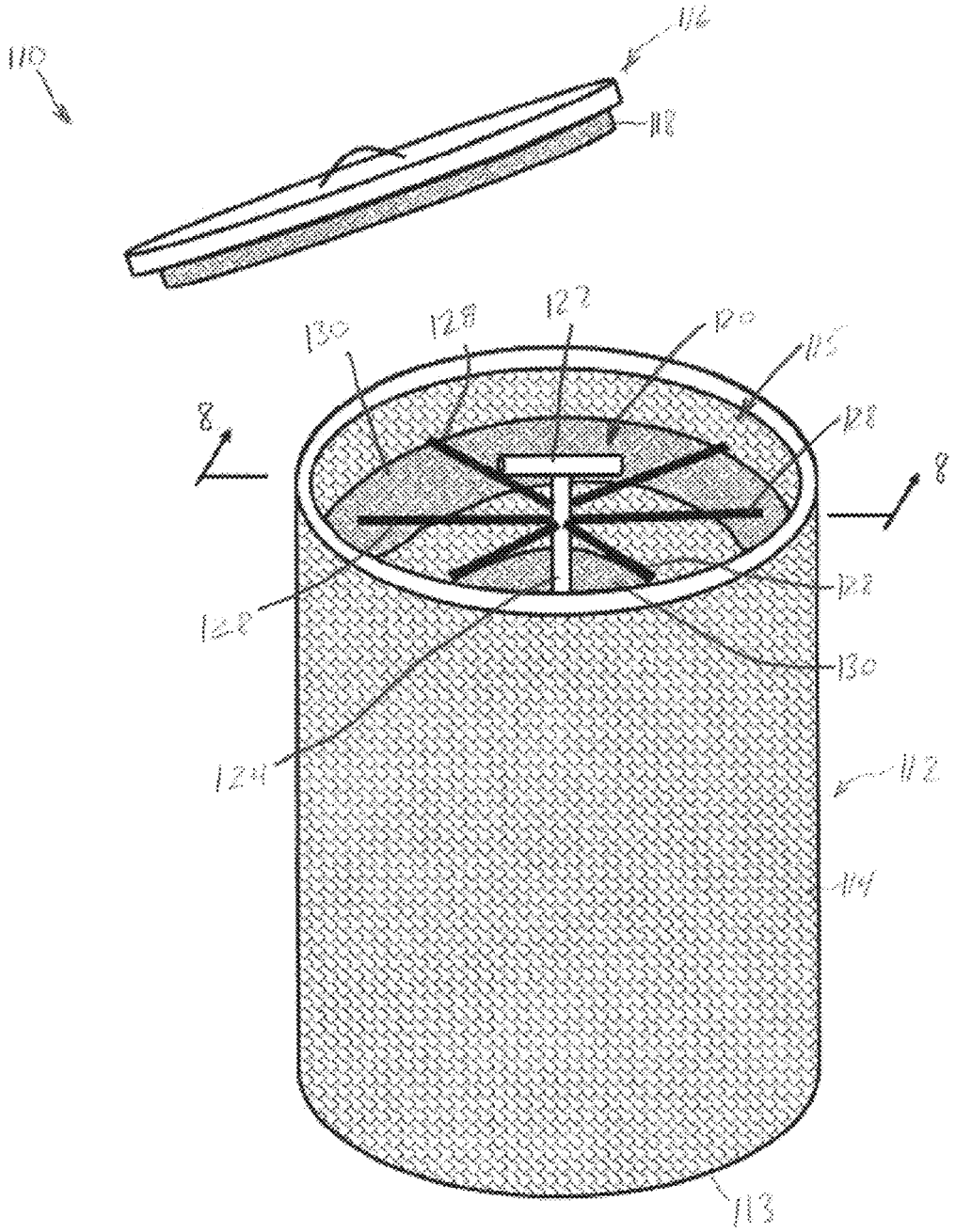
FIG. 7 is a perspective view of an exemplary wet clothes drying hamper in accordance with another embodiment of the invention with the lid removed.
Figure 8:
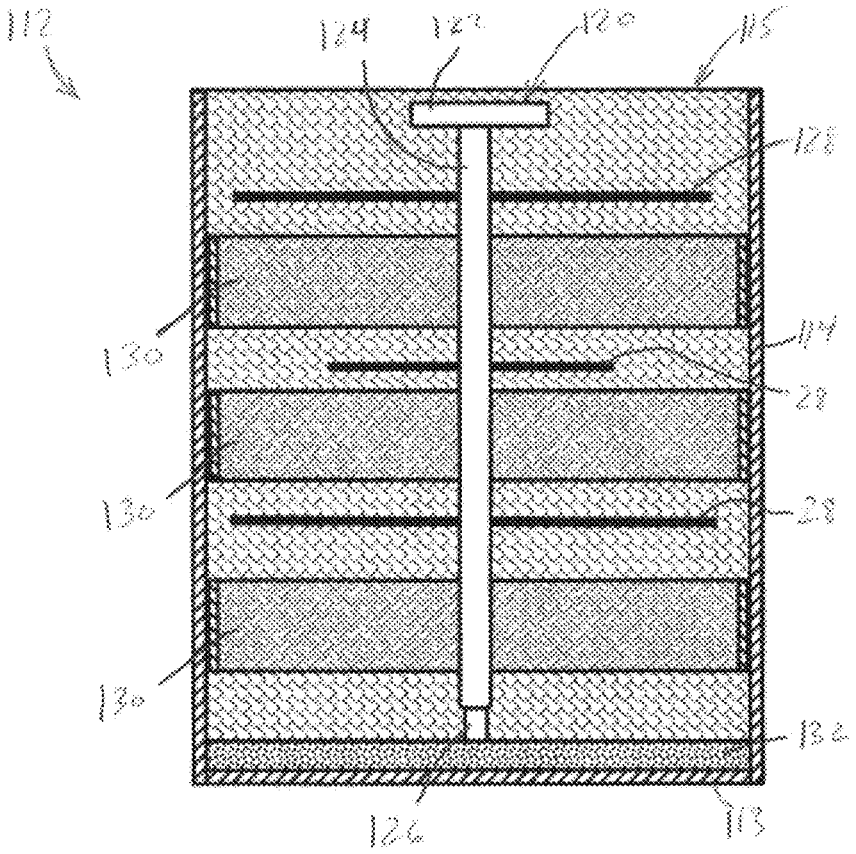
FIG. 8 is a cross-sectional view along the line 8-8 in FIG. 7 showing the telescoping pole assembly in a retracted position.
Figure 9:
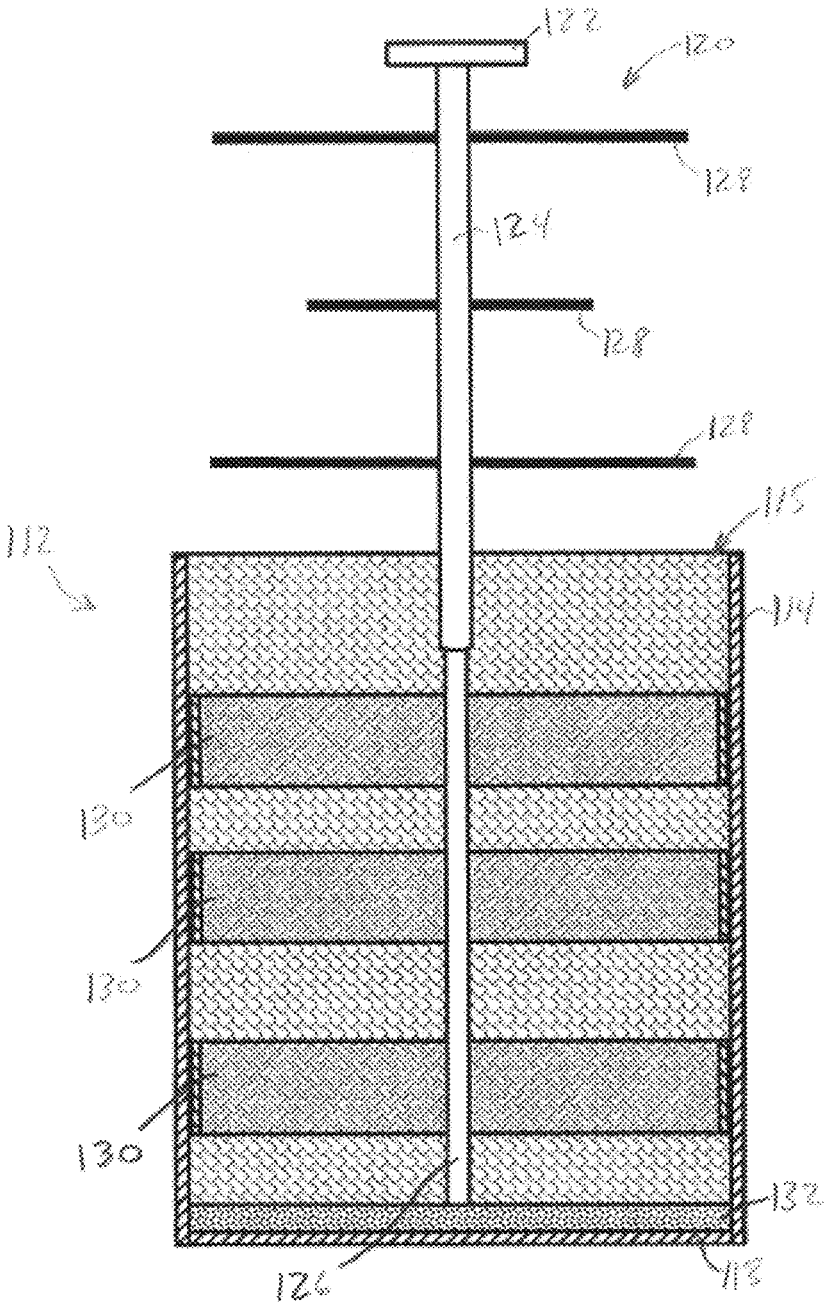
FIG. 9 is a cross-sectional view similar to FIG. 8 showing the telescoping pole assembly in an extended position.

Referring to FIGS. 7-9, an exemplary wet clothes drying hamper 110 in accordance with another embodiment of the invention will be described. The hamper 110 includes a basket 112 and a cover 116. The basket 112 is preferably a normal size hamper body 114 extending between a closed end 113 and an open end 115. In the present embodiment, the basket 112 is shown having a round configuration but may have any desired configuration as in the previous embodiments. Preferably it has aesthetically pleasing modern looking exterior. The basket body 114 preferably is made of high quality plastic or other desired materials and has passages therethrough, for example, due to a mesh configuration, to allow for ventilation.

On the interior, the basket 112 preferably includes cedar strips or panels 130, or the like, which absorb moisture and odor and provide a pleasant smell. The panels 130 may take up any desired surface area, but preferably have space therebetween or holes therethrough such that air can circulate through the basket 112. In the illustrated embodiment, the cover 116 also has a cedar panel 118 on the interior surface thereof. At the closed end 113 of the basket 112, an absorbent mat 132 is preferably provided to collect moisture which may drip from the clothes. The mat 132 is preferably a thick, industrial absorbent mat as in the previous embodiment.

A telescoping pole assembly 120 within the basket 112 defines the extension assembly and rack assembly of the present embodiment. The telescoping pole assembly 120 includes an outer pole 124 and an inner pole 126. The inner pole 126 is secured relative to the closed end 113 of the basket 112. The outer pole 124 includes a handle 122 which may be grasped to extend the outer pole 124 from the retracted position shown in FIG. 8 to the extended position shown in FIG. 9. As an alternative, the outer pole 124 may be connected to the lid 116 such that the lid may be used to extend the outer pole 124. A push button or the like may be provided between the outer and inner poles 124, 126 to lock the outer pole 124 in the extended position if desired. A plurality of hanging rods 128 extend outwardly from the outer pole 124 and are configured to hang wet clothes thereon. The hanging rods 128 may be provided in any desired configuration.

In operation, a user removes the cover 116 and extends the outer pole 124 to the extended position illustrated in FIG. 9. The wet clothes are then hung on the hanging rods 128 and thereafter the outer pole 124 is lowered to the retracted position such that the hanging rods 128, and thereby the wet clothes, are supported within the basket 112 in a non-piled configuration. The cover 116 may be returned to the open end 115 of the basket 112. The non-piled wet clothes more easily dry do to ventilation through the basket 112 along with absorption by the cedar panels 130 and the mat 132.

These and other advantages of the present invention will be apparent to those skilled in the art from the foregoing specification. Accordingly, it will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as defined in the claims.

What is claimed is:

1. A clothes hamper comprising:

a hamper body extending from a generally closed end to a generally open end with an interior chamber defined within the hamper body;

a rack assembly defining one or more hanging elements, the rack assembly sized and configured to fit within the interior chamber; and an extension assembly positioned within the interior chamber, the extension assembly configured to facilitate movement of the rack assembly between a retracted position within the interior chamber and an extended position wherein at least a portion of the rack assembly is outside of the hamper body.

2. The clothes hamper according to claim 1 further comprising a cover configured to substantially close the open end of the hamper body.

3. The clothes hamper according to claim 2 wherein the cover is attached to the rack assembly.

4. The clothes hamper according to claim 2 wherein the cover is independent of the rack assembly.

5. The clothes hamper according to claim 2 wherein the cover has a moisture absorbing material provided along an inside surface thereof.

6. The clothes hamper according to claim 1 wherein the hamper body has air flow passages therethrough.

7. The clothes hamper according to claim 6 wherein moisture absorbing panels are attached to an interior surface of the hamper body, each moisture absorbing panel aligned with a respective air flow passage.

8. The clothes hamper according to claim 7 wherein the moisture absorbing panels are spaced from the interior surface such that air may flow through the air flow passages and about the moisture absorbing panels.

9. The clothes hamper according to claim 6 wherein moisture absorbing panels are attached to an interior surface of the hamper body, positioned independently of the air flow passages.

10. The clothes hamper according to claim 1 wherein a moisture absorbing mat is positioned along a closed end of the hamper body.

11. The clothes hamper according to claim 10 wherein the moisture absorbing mat is positioned on a support surface of a draw which extends into the hamper body and is movable relative thereto.

12. The clothes hamper according to claim 1 wherein at least portions of the rack assembly are made from a moisture absorbing material.

13. The clothes hamper according to claim 1 wherein the rack assembly includes a plurality of shelves, with each shelf including a plurality of spaced apart hanging rods.

14. The clothes hamper according to claim 1 wherein the rack assembly includes a plurality of hanging rods extending radially from a first pole.

15. The clothes hamper according to claim 14 wherein the extension assembly includes the first pole which is telescopically supported relative to a second pole secured within the interior chamber.

16. The clothes hamper according to claim 15 wherein an end of the first pole opposite the second pole includes a handle.

17. The clothes hamper according to claim 1 wherein the extension assembly includes a scissor lift assembly.

18. The clothes hamper according to claim 17 wherein the extension assembly further includes at least one pneumatic strut.

* * * * *